United States Patent [19]

Rydberg

[11] 4,010,663

[45] Mar. 8, 1977

[54] MULTIPLE HAND TOOL

[76] Inventor: Allan Rydberg, 76 Chapman Ave., Warwick, R.I. 02886

[22] Filed: Apr. 28, 1976

[21] Appl. No.: 681,130

[52] U.S. Cl. ..... 81/71; 145/50 C; 81/177 E

[51] Int. Cl.[2] ..... B25B 13/48

[58] Field of Search ..... 81/71, 177 E; 145/50 C

[56] References Cited

UNITED STATES PATENTS

| | | | |
|---|---|---|---|
| 2,786,380 | 3/1957 | Rolland | 81/71 |
| 3,850,056 | 11/1974 | Allen | 81/71 |
| 3,892,149 | 7/1975 | Rydberg | 81/71 |
| 3,943,801 | 3/1976 | Yates | 81/71 |

*Primary Examiner*—James L. Jones, Jr.
*Attorney, Agent, or Firm*—Max Schwartz

[57] ABSTRACT

A hand tool for a variety of tools such as Allen wrenches, screw drivers, Philips drivers, twist drills, taps, etc. A multiplicity of tools, or different sized tools, are mounted on a single tool handle. The cylindrical handle is provided with a central axial socket member having a central axial opening. Extending from the front edge rearwardly, the handle has a plurality of circumferentially spaced, parallel, grooves. Each tool comprises a base portion adapted to fit into the axial opening of the socket member. Various methods may be used to lock the tool against rotation, such as five or six sides, tapers, keyways, etc. The elongated tool member extends axially from the base portion. Each base portion is mounted in a loop holder which is hinged on a short wire support having elongated spaced parallel wire arms extending at right angles from the short wire portion. Each tool is mounted in its groove by inserting the elongated wire arms into the groove. The wire is slidable in the groove and provision is made to prevent its pulling out. In this position, the tool can be pivoted to align with the axial opening and can be pushed into the opening to lock in place. To remove the tool, it can be pulled from the opening and pivoted into its groove and then pushed out of the way.

10 Claims, 4 Drawing Figures

30
28
34
26
46
32
20
16
12
14
22
18
42
10
44
24

30
28
34
36
32
46
26
38
42
40
42
44

18
24
10
26
42
16
14

30
28
34
32
36
26
16
20
28
20
22
18
24
18
10

MULTIPLE HAND TOOL

BACKGROUND OF THE INVENTION.

This invention comprises an improvement over my U.S. Pat. No. 3,892,149, issued July 1, 1975, and entitled Multiple Hand Tool. In the construction shown therein, each tool is permanently mounted on the handle. This requires a different tool for each different use, there being no flexibility.

SUMMARY OF THE INVENTION

The present invention provides flexibility by allowing any tool or combination of tools to be mounted or removed from the common handle. Thus a variety of tools can be used, such as Allen wrenches, screw drivers, Philips drivers, twist drills, taps, etc. A cylindrical handle is provided with a central axial socket member having a central axial opening. Extending from the front edge rearwardly, the handle has a plurality of grooves. Each tool comprises a base portion adapted to fit into the axial opening, the tool being locked against rotation in the opening. Each base portion is mounted in a loop holder hinged to a U-shaped wire having elongated spaced arms. The tool is mounted in the groove by sliding the wire arms into the grooves, provision being made to prevent its sliding out. When the tool is pivoted in alignment with the axial opening, it can be pushed into the opening and be ready for use. To remove the tool, it is pulled from the opening and pivoted into the groove and slid back into the handle out of the way.

DESCRIPTION OF THE INVENTION

Figures 1, 2, 3, 4:
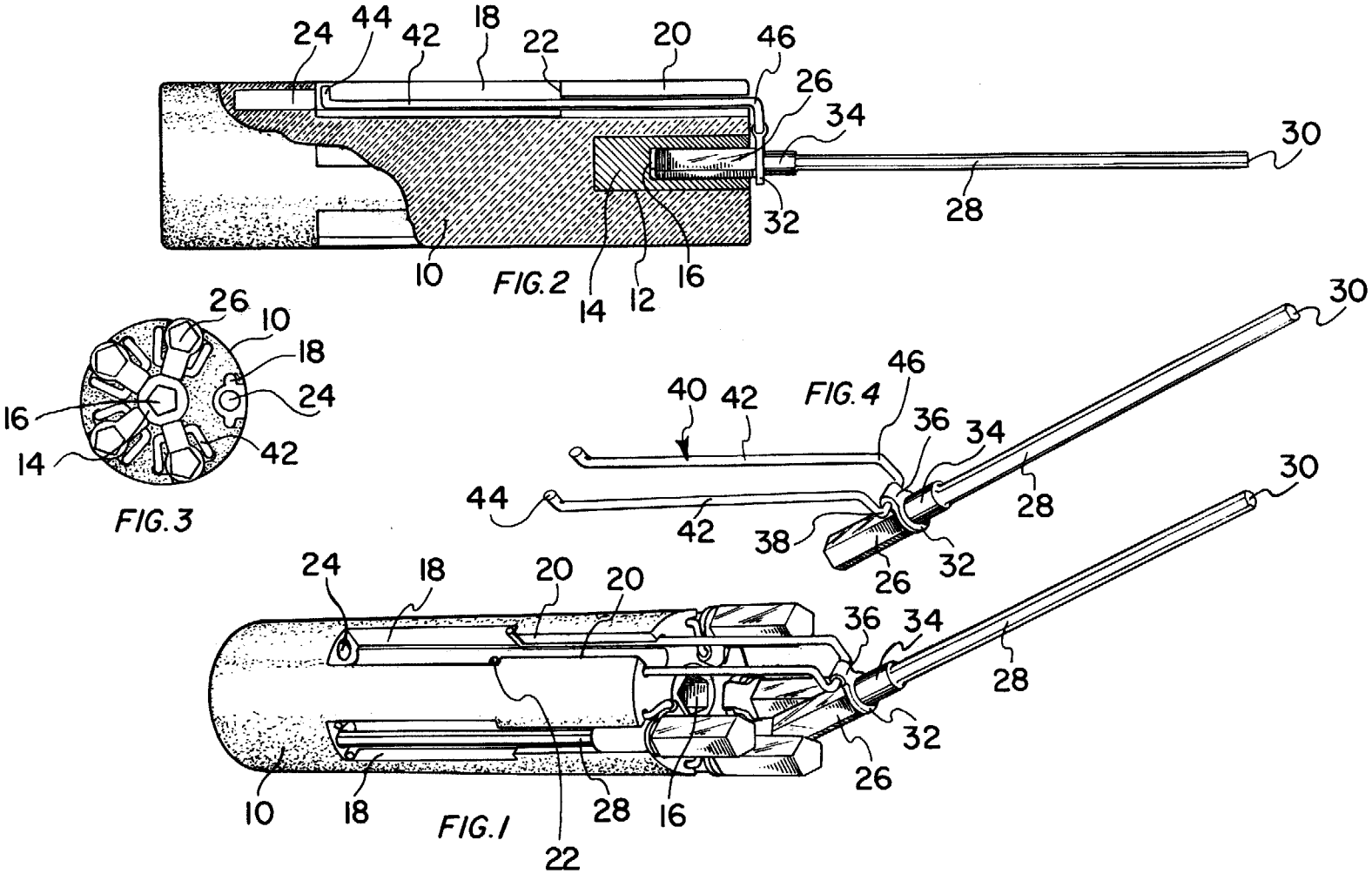
FIG. 1 is a perspective view of the hand tool with one tool in partially open position.
FIG. 2 is a longitudinal section of the tool.
FIG. 3 is a front elevation of the tool.
FIG. 4 is a perspective view of one of the tool members unmounted from the handle.

Referring more in detail to the drawings, the improved hand tool comprises a cylindrical handle 10 which can be of wood, plastic, or any other suitable material. The handle 10 is provided with a central axial opening 12 extending into the handle from the front end. A steel socket member 14 is tightly mounted in the opening 12 and is provided with a central axial opening 16. The selected tool must be mounted in the opening 16 and locked against rotation. This can be done by providing the opening and tools with complementary locks such as five or six sides, tapers, keys, or any other device. For the purposes of illustration, the opening 16 has been shown as a five-sided opening and the base of each tool is also five-sided to nest in the opening.

A plurality of grooves 18, five illustrated, extend rearwardly from the front end of the handle 10. Each groove 18 is provided in its forward half with restricted portions 20 extending toward each other to provide overhanging portions. These portions 20 form shoulders 22 at their rear ends. At the rear end of each groove, the handle is provided with a cut out opening 24 for receiving the end of the tool when it is positioned in its groove.

Each individual tool mounted on the handle 10 is made as illustrated in FIG. 4. Each tool comprises a base portion 26 having the same section as the axial opening 16, as hereinabove described, 5 sides being illustrated. The shank of the tool 28 extends from the base 26 and terminates at a free end 30 where it is shaped into the desired tool, such as an Allen wrench, Philips driver, screw driver, twist drill, tap, etc. At this point it should be noted that, while the illustration shows five tools, it is obvious that more or less can be provided. Also, while the tool can comprise a single type in different sizes, a combination of tools can be mounted on a single handle, since each is readily removable and replaceable.

A ring or loop 32 is slipped over the shank 28 until it abuts the inner end of the base portion 26. A lock collar 34 is slipped over the shank to lock the tool to the loop holder 32, allowing rotation of the tool for adjustment. The loop holder 32 has an integral extended portion 36 which forms a bearing for the short base 38 of the wire member 40. The wire supporting member 40 has two parallel arms 42 extending integrally from the portion 38 and terminating in tips 44 turned at right angles to the arms. Adjacent the portion 36, the arms 42 are bent downwardly at 46 to allow for proper alignment as hereinafter described.

To mount the tool shown in FIG. 4 in the tool handle 10, the wire arms 42 are pinched toward each other and inserted in one of the grooves 18. As can be seen in FIG. 2, the arms 42 will resiliently slip under the overhanging portions 20 to retain the arms in the groove. Furthermore, the ends 44 of the arms will abut the shoulders 22 in the extreme outward position to prevent the wire arms from sliding out of the groove. The resilient arms will tend to engage the side walls of the groove to provide a friction fit.

To operate, the selected tool is pulled out, the arms sliding in the groove, into the position shown in FIG. 2. The tool is now pivoted until it is in alignment with the axial opening 16. The tool can now be pushed into the opening, rotation being permitted to allow the fit. The tool is now ready for use. To remove the tool, the action is reversed. The tool is pulled from the axial opening and pivoted back until the shank 28 lies in the groove. The assembly is pushed inwardly until the end of the shank enters the undercut opening 24 to hold it in withdrawn position. At the other end of the tool, the base member 26 is all that will extend from the end of the handle.

Since the tool assemblies shown in FIG. 4 can be easily manually mounted or removed from the handle, the user can have a single handle and a plurality of different tools, either of different sizes or a variety of tools. The tools can thus be assembled on the handle before each job to provide a plurality of tools for the particular job.

The above construction thus provides a great deal of flexibility in a multiple hand tool. The do-it-yourselfer can add to the tools as his needs appear. The tool is comparatively much less expensive to manufacture and assemble than the fixed multiple tool constructions. Other advantages of the present invention will be readily apparent to a person skilled in the art.

I claim:

1. A multiple hand tool comprising a cylindrical handle, a socket member mounted axially in said handle and having a central axial opening, a plurality of circumferentially spaced grooves in said handle extending rearwardly from the front end, a plurality of hand tools mounted in said grooves, each of said hand tools comprising a base portion adapted to fit into said socket opening, an integral elongated shank extending from said base, the outer end of said shank forming the hand tool, a U-shaped wire supporting member having a short central portion and spaced parallel arms extending integrally at right angles from said central portion, said tool base portion being pivotally mounted on said central portion, said wire arms being slidably mounted in said groove to mount a tool in said groove, whereby said tool can be pivoted to nest in its groove and pivoted outwardly in alignment with said socket opening, said wire arms permitting sliding movement to nest said base in said opening.

2. A multiple hand tool as in claim 1, wherein means are provided for retaining said wire arms in said groove.

3. A multiple hand tool as in claim 1, wherein means are provided for limiting the axial sliding movement of said wire arms in said groove.

4. A multiple hand tool as in claim 1, wherein means are provided for locking said base in said axial opening against rotation.

5. A multiple hand tool as in claim 2, wherein said retaining means comprises integral wall portions extending toward each other to form a restricted groove portion, said wire arms sliding under said restricted groove portions.

6. A multiple hand tool as in claim 3, wherein said limiting means comprises upturned ends on said wire arms and shoulders in said groove, whereby said upturned ends will abut said shoulders to limit the axial movement of said arms.

7. A multiple hand tool as in claim 4, wherein said locking means comprises complementary shapes of said axial opening and said base to nest said base in said opening without rotation.

8. A multiple hand tool as in claim 2, wherein means are provided for limiting the axial sliding movement of said wire arms in said groove.

9. A multiple hand tool as in claim 8, wherein means are provided for locking said base in said axial opening against rotation.

10. A multiple hand tool as in claim 9, wherein said retaining means comprises integral wall portions extending toward each other to form a restricted groove portion, said wire arms sliding under said restricted groove portions, and wherein said limiting means comprises upturned ends on said wire arms and shoulders in said groove, whereby said upturned ends will abut said shoulders to limit the axial movement of said arms.

* * * * *